US009190784B1

(12) United States Patent
Oh et al.

(10) Patent No.: US 9,190,784 B1
(45) Date of Patent: Nov. 17, 2015

(54) HIGH PERFORMANCE CONTACT ELEMENT

(71) Applicant: TYCO ELECTRONICS CORPORATION, Berwyn, PA (US)

(72) Inventors: Lawrence Se-Jun Oh, Hummelstown, PA (US); John Louis McKibben, Dallastown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/336,356

(22) Filed: Jul. 21, 2014

(51) Int. Cl.
*H01R 13/187* (2006.01)
*H01R 24/28* (2011.01)

(52) U.S. Cl.
CPC ..... *H01R 24/28* (2013.01)

(58) Field of Classification Search
CPC ..... H01R 13/187
USPC ..... 439/840, 841, 843, 885, 739
See application file for complete search history.

(56) References Cited

U.S. PATENT DOCUMENTS

| | | | | |
|---|---|---|---|---|
| 3,453,587 | A * | 7/1969 | Neidecker | 439/843 |
| 3,861,776 | A * | 1/1975 | Deal | 439/843 |
| 6,062,919 | A * | 5/2000 | Trafton | 439/843 |
| 6,183,904 | B1 | 2/2001 | Kuboshima et al. | |

FOREIGN PATENT DOCUMENTS

| | | | |
|---|---|---|---|
| DE | 1590124 | A1 | 3/1970 |
| EP | 0 093 628 | A2 | 11/1983 |
| EP | 1439610 | A2 | 7/2004 |
| EP | 1737082 | A2 | 12/2006 |
| FR | 2 941 819 | A1 | 8/2010 |
| WO | 2013/052571 | A1 | 4/2013 |

* cited by examiner

*Primary Examiner* — Tho D Ta

(57) ABSTRACT

A contact element for providing high current capabilities between an electrical contact and a mating contact. The contact element includes multiple first resilient contact arms and multiple second resilient contact arms. The first contact arms and the second contact arms have first contact sections and second contact sections. The first contact sections electrically engage the mating contact when the mating contact is fully inserted into the electrical contact. The second contact sections electrically engage a portion of the electrical contact when the mating contact is fully inserted into the electrical contact. The first contact sections and the second contact sections provide redundant contact sections which allow for the passage of a high amperage current with low resistance and low temperature.

15 Claims, 7 Drawing Sheets

HIGH PERFORMANCE CONTACT ELEMENT

FIELD OF THE INVENTION

The present invention is directed to a contact element which provides a quick and simple connection to a mating contact. In particular, the invention is directed to a contact element which provides high current capabilities while providing a reliable connection to the mating contact.

BACKGROUND OF THE INVENTION

Electrical connectors for military, aviation, vehicular and other applications which required power must be able to withstand the environmental conditions, such as high vibrations, to which such connectors are subjected. The connectors also must provide high quality electrical connection through very broad ranges of temperature variations. In many instances these electrical connectors must also accommodate extremely high amperage.

Examples of such electrical connectors which are found in the prior art may include a threaded stud terminal to which a threaded nut may be selectively connected. A typical prior art terminal for connection to such threaded stud terminal includes a mating end effectively defining a generally planar eyelet that is dimensioned to be slidably passed over the threaded stud terminal. The opposed end of such a terminal typically will be crimped and/or soldered to a conductor of the wire. The eyelet is maintained in a mated condition on the threaded stud terminal by the nut which is threaded tightly against the planar portion of the eyelet for securely retaining the terminal on the threaded stud terminal and for providing the high contact forces that are desired.

Such typical prior art electrical connector performs well under routine environmental conditions. However, the threaded components of these prior art connectors are fairly expensive to manufacture. Furthermore, the threaded interconnection adds significantly to assembly time and costs and can make disassembly for periodic repair and maintenance difficult, particularly as torque wrenches are required to properly seat the hardware. A number of parts are required to perfect the electrical connection, thereby also adding to the cost of the connection and creating the possibility of foreign object debris (FOD) which could damage engines and the like. Also, as the connectors are exposed to vibration and the like, the nuts may rotate off of the threaded component, which can lead to a failed, open electrical connection. In addition, any attempt to provide environmental sealing for such an electrical connection will generally require an entirely separate protection means that is functionally and structurally unrelated to the threaded interconnection to the alternator.

Various prior art electrical connectors rely upon resiliency of the metal to achieve electrical connection. However, it is extremely difficult to achieve the high contact forces with an electrical connector that must also ensure a large surface contact area and a large cross sectional area of metal to effect a reliable electrical connection.

Other examples of prior art electrical connectors have included springs means which are intended to achieve secure electrical connection without resorting to combinations of threads and nuts. On such contact is disclosed in German Pat. No. 15 90 124. It has proven to be disadvantageous with these known contact spring sockets that one must have a relatively large sleeve to mount the contact springs and hold them in place, particularly in the case where one attempts miniaturization of contact spring sockets.

It would, therefore, be beneficial to provide a contact element which has a relatively simple structure, can be inexpensively manufactured, and is of compact size, yet has high current carrying capacity and low required plug insertion forces.

SUMMARY OF THE INVENTION

In view of the above, it is an object of the subject invention to provide a contact element which is compact, thereby allowing a number of contact elements to be used.

It is another object of the subject invention to provide contact elements which are reliable and have high current capabilities.

It is another object of the subject invention to a high amperage contact element which can be used over many cycles and which enables quick connection and disconnection.

It is another object of the subject invention to provide a system in which increased contact points are provided between a contact element and the mating post.

An embodiment is directed to a contact element for providing high current capabilities between an electrical contact and a mating contact. The contact element includes multiple first resilient contact arms and multiple second resilient contact arms. The multiple first resilient contact arms extend from a carrier strip. The first contact arms have first contact sections and second contact sections. The first contact sections of the first contact arms electrically engage the mating contact when the mating contact is fully inserted into the electrical contact. The second contact sections of the first contact arms electrically engage a portion of the electrical contact when the mating contact is fully inserted into the electrical contact. The multiple second resilient contact arms extend from a carrier strip. The second contact arms have first contact sections and second contact sections. The first contact sections of the second contact arms electrically engage the mating contact when the mating contact is fully inserted into the electrical contact. The second contact sections of the second contact arms electrically engage a portion of the electrical contact when the mating contact is fully inserted into the electrical contact. The first contact sections of the first contact arms, the second contact sections of the first contact arms, the first contact sections of the second contact arms, and the second contact sections of the second contact arms provide redundant contact sections which allow for the passage of a high amperage current with low resistance and low temperature.

An embodiment is directed to an electrical contact for mating with a mating contact. The electrical contact includes a passage for receiving a mating contact, the passage having at least one recess, the at least one recess having an outer contact surface. At least one contact element is positioned in the at least one recess. The at least one contact element includes multiple first resilient contact arms and multiple second resilient contact arms. The multiple first resilient contact arms extend from a carrier strip. The first contact arms have first contact sections and second contact sections. The first contact sections of the first contact arms electrically engage the mating contact when the mating contact is fully inserted into the electrical contact. The second contact sections of the first contact arms electrically engage a portion of the electrical contact when the mating contact is fully inserted into the electrical contact. The multiple second resilient contact arms extend from a carrier strip. The second contact arms have first contact sections and second contact sections. The first contact sections of the second contact arms electrically engage the mating contact when the mating contact is fully inserted into the electrical contact. The second contact sections of the second contact arms electrically engage a portion of the electrical contact when the mating contact is fully inserted into the electrical contact. The first contact sections of the first contact arms, the second contact sections of the first contact arms, the first contact sections of the second contact arms, and the second contact sections of the second contact arms provide redundant contact sections which allow for the passage of a high amperage current with low resistance and low temperature.

An embodiment is directed to an electrical contact. The electrical contact includes a passage for receiving a mating contact, the passage having at least one recess, the at least one recess having retaining shoulders and an outer contact surface. At least one contact element is positioned in the at least one recess. The at least one contact element includes multiple first resilient contact arms and multiple second resilient contact arms. The multiple first resilient contact arms extend from a carrier strip. The first contact arms have first contact sections and second contact sections. The first contact sections of the first contact arms electrically engage the mating contact when the mating contact is fully inserted into the electrical contact. The second contact sections of the first contact arms electrically engage a portion of the electrical contact when the mating contact is fully inserted into the electrical contact. The multiple second resilient contact arms extend from a carrier strip. The second contact arms have first contact sections and second contact sections. The first contact sections of the second contact arms electrically engage the mating contact when the mating contact is fully inserted into the electrical contact. The second contact sections of the second contact arms electrically engage a portion of the electrical contact when the mating contact is fully inserted into the electrical contact. Third contact sections are provided on the first and second resilient contact arms, the third contact sections of the first and second contact arms electrically engage the retaining shoulders of the at least one recess when the mating contact is fully inserted into the electrical contact.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
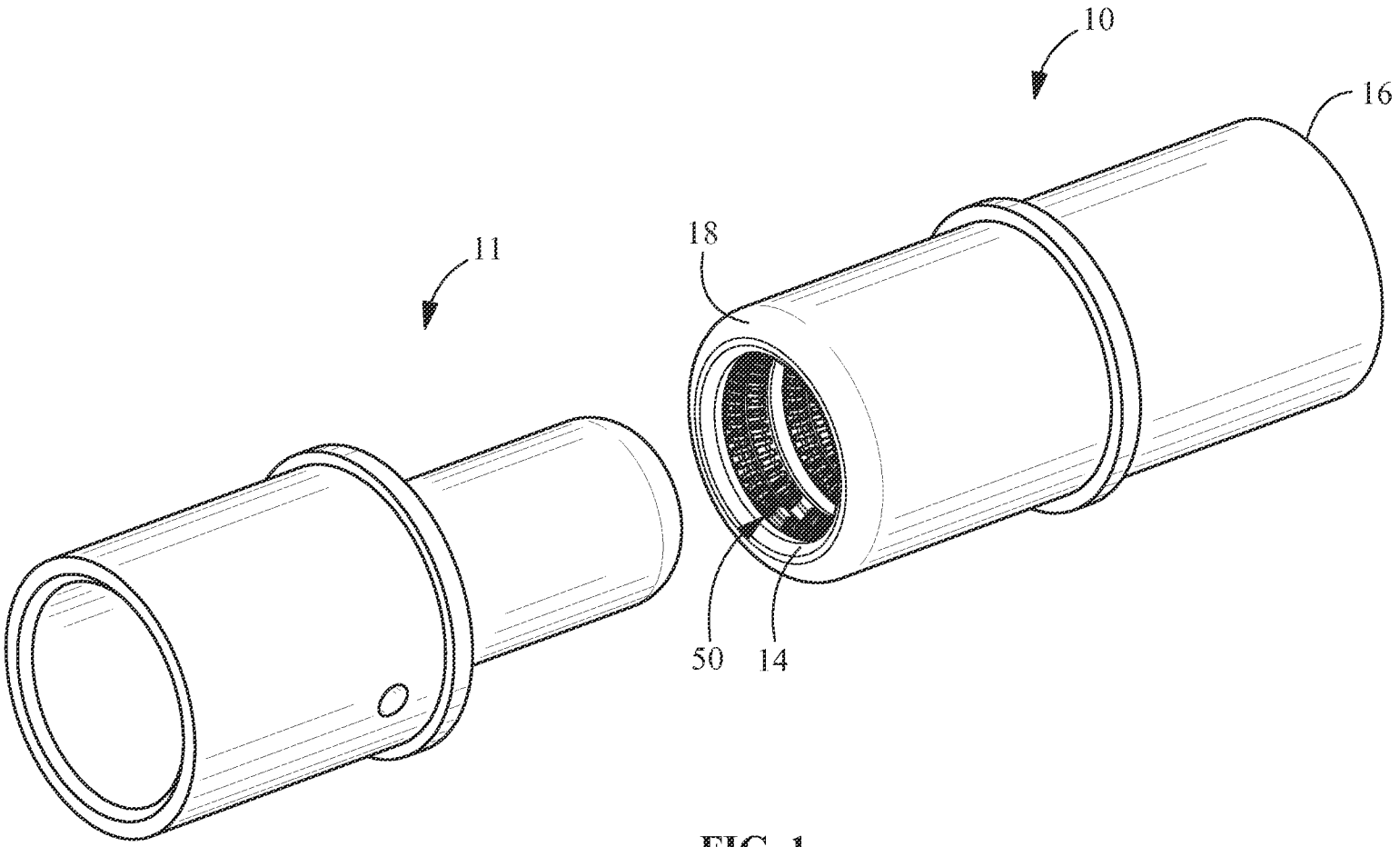
FIG. 1 is a perspective view of an illustrative male contact prior to insertion into a receiving cavity of an illustrative female contact, the female contact having contact elements of the present invention inserted therein.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the illustrative embodiments. Accordingly, the invention expressly should not be limited to such illustrative embodiments illustrating some possible non-limiting combination of features that may exist alone or in other combinations of features; the scope of the invention being defined by the claims appended hereto.

The present invention is directed to a contact element which provides a quick and simple connection to a mating contact. In particular, the invention is directed to a contact element which provides high current capabilities while providing a reliable connection to the mating contact. While the contact element 50 is shown positioned in an exemplary electrical contact 10, the contact assembly 50 may be used with many different types of contacts or contact assemblies. The use of the contact element 50 is, therefore, not limited to use with the illustrative electrical contact and/or the mating contact disclosed herein.

Figure 2:
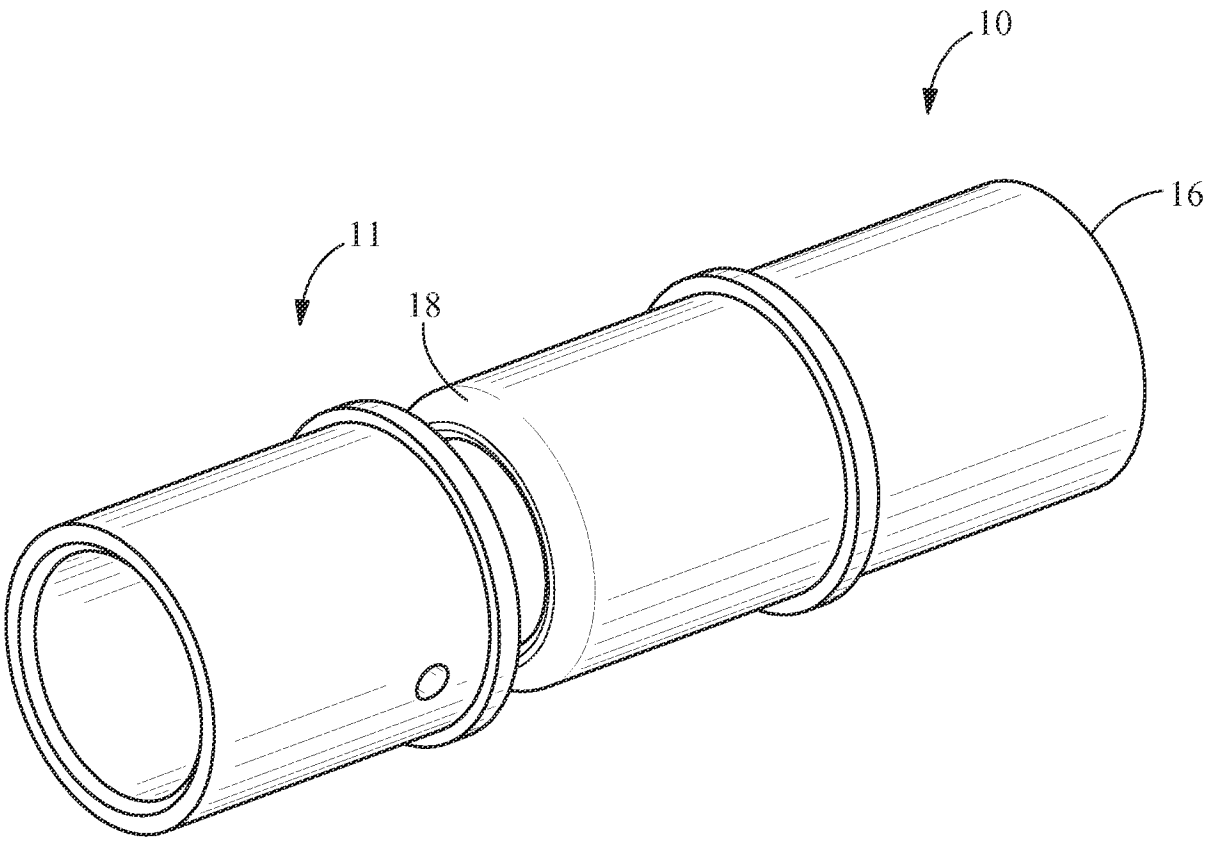
FIG. 2 is a perspective view of the illustrative male contact of FIG. 1 inserted into the receiving cavity of the female contact.
Figure 3:
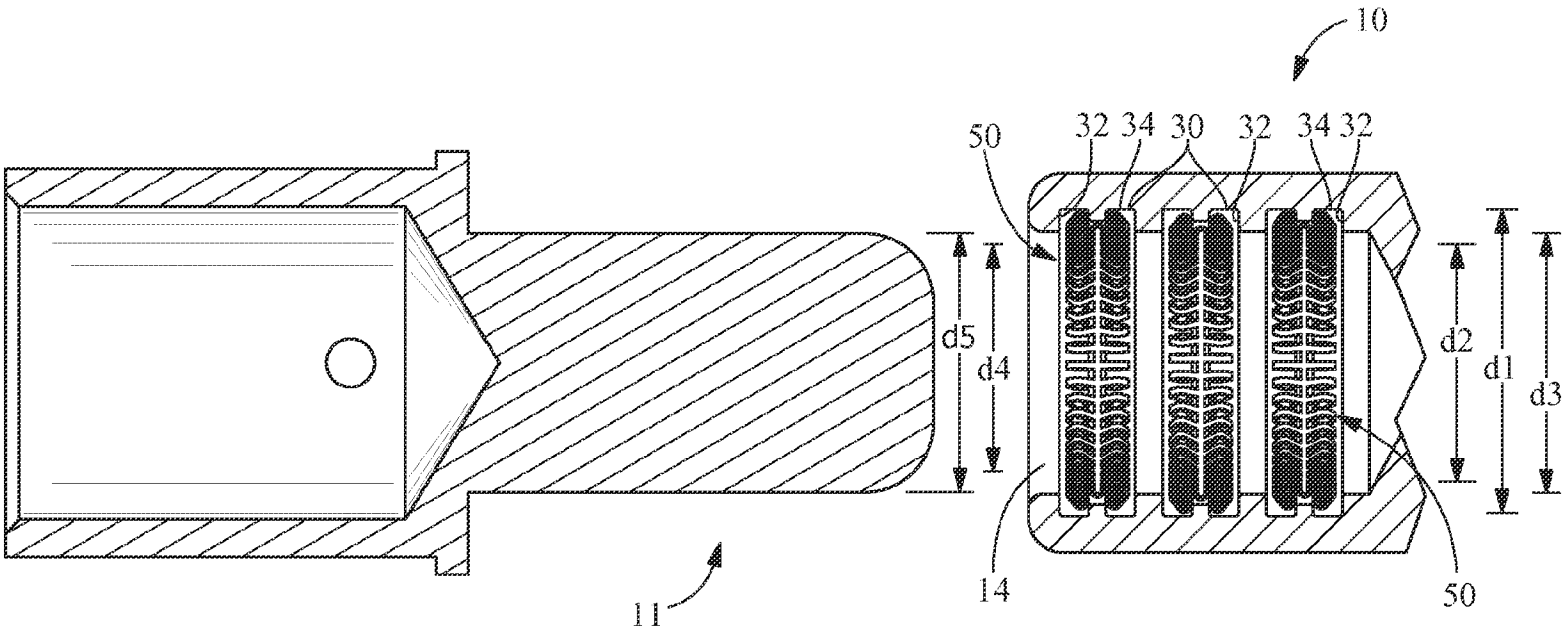
FIG. 3 is a partial cross-sectional view taken along line 3-3 of FIG. 1 illustrating the contact elements positioned in the receiving cavity of the female contact prior to the male contact being inserted into the receiving cavity.
Figure 4:
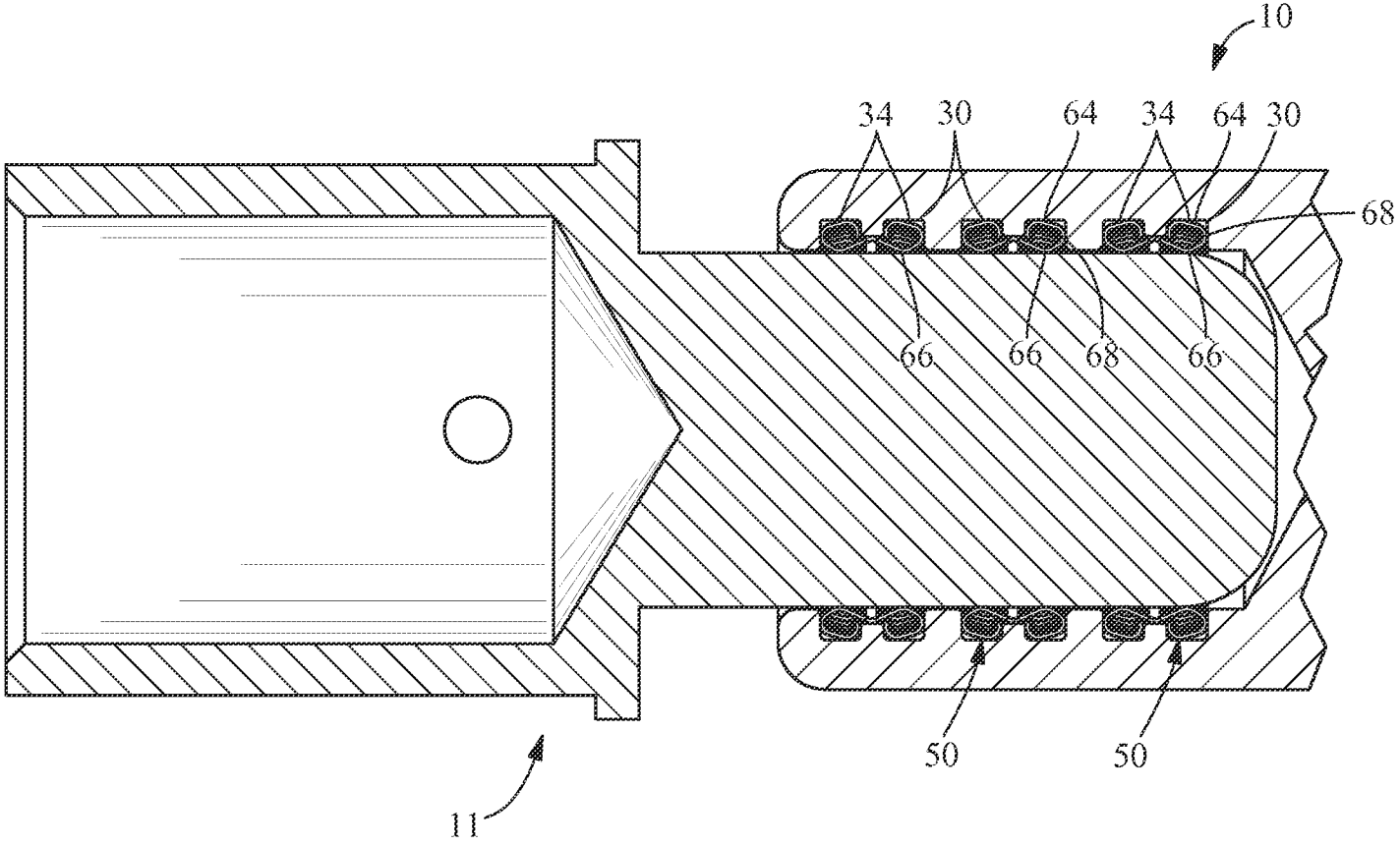
FIG. 4 is a partial cross-sectional view taken along line 4-4 of FIG. 2 illustrating the contact elements positioned in the receiving cavity of the female contact prior with the male contact inserted into the receiving cavity.
Figure 5:
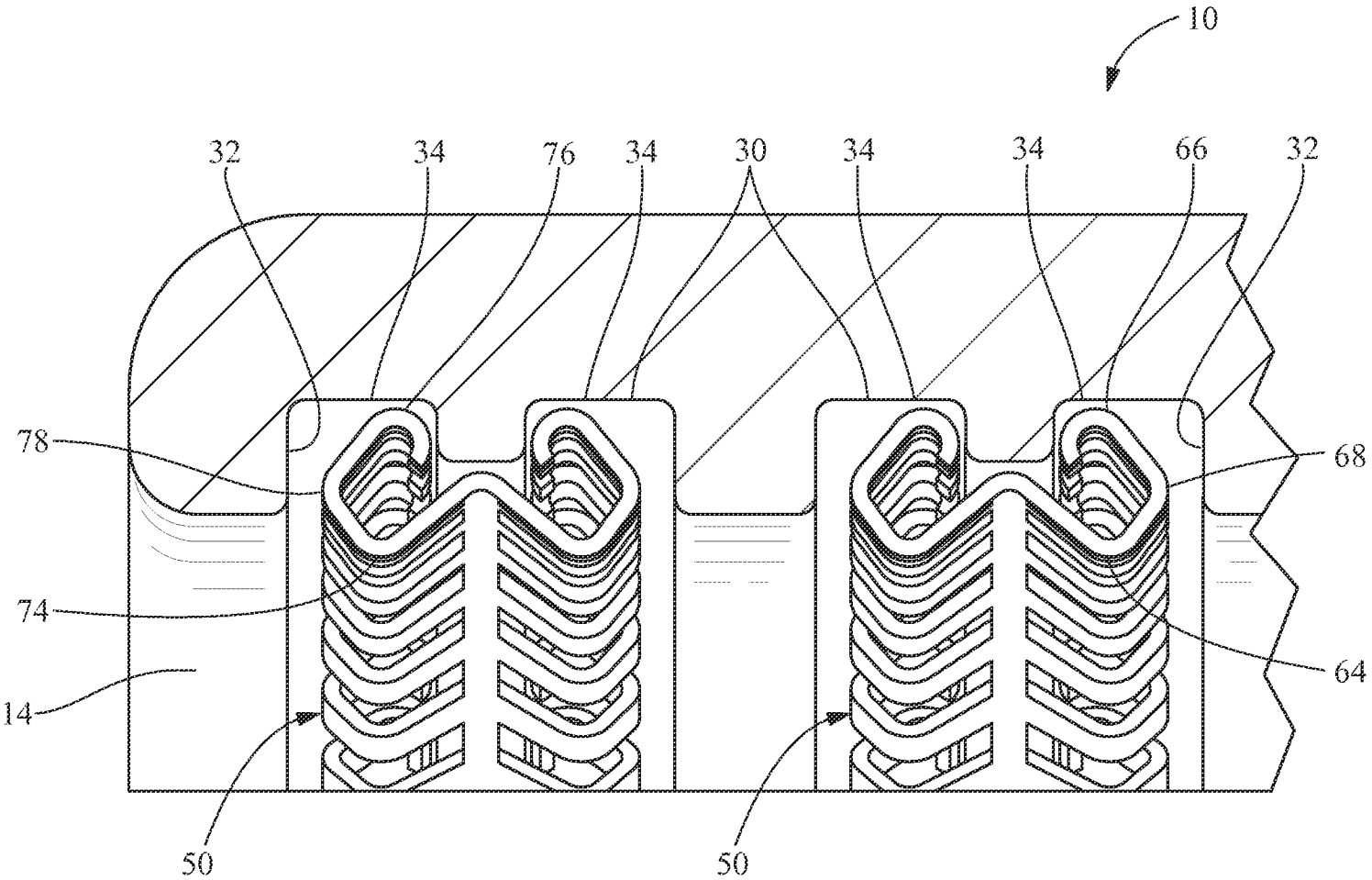
FIG. 5 is an enlarged cross-sectional view of FIG. 3 illustrating the contact elements positioned in the receiving cavity of the female contact prior to the male contact being inserted into the receiving cavity.
Figure 6:
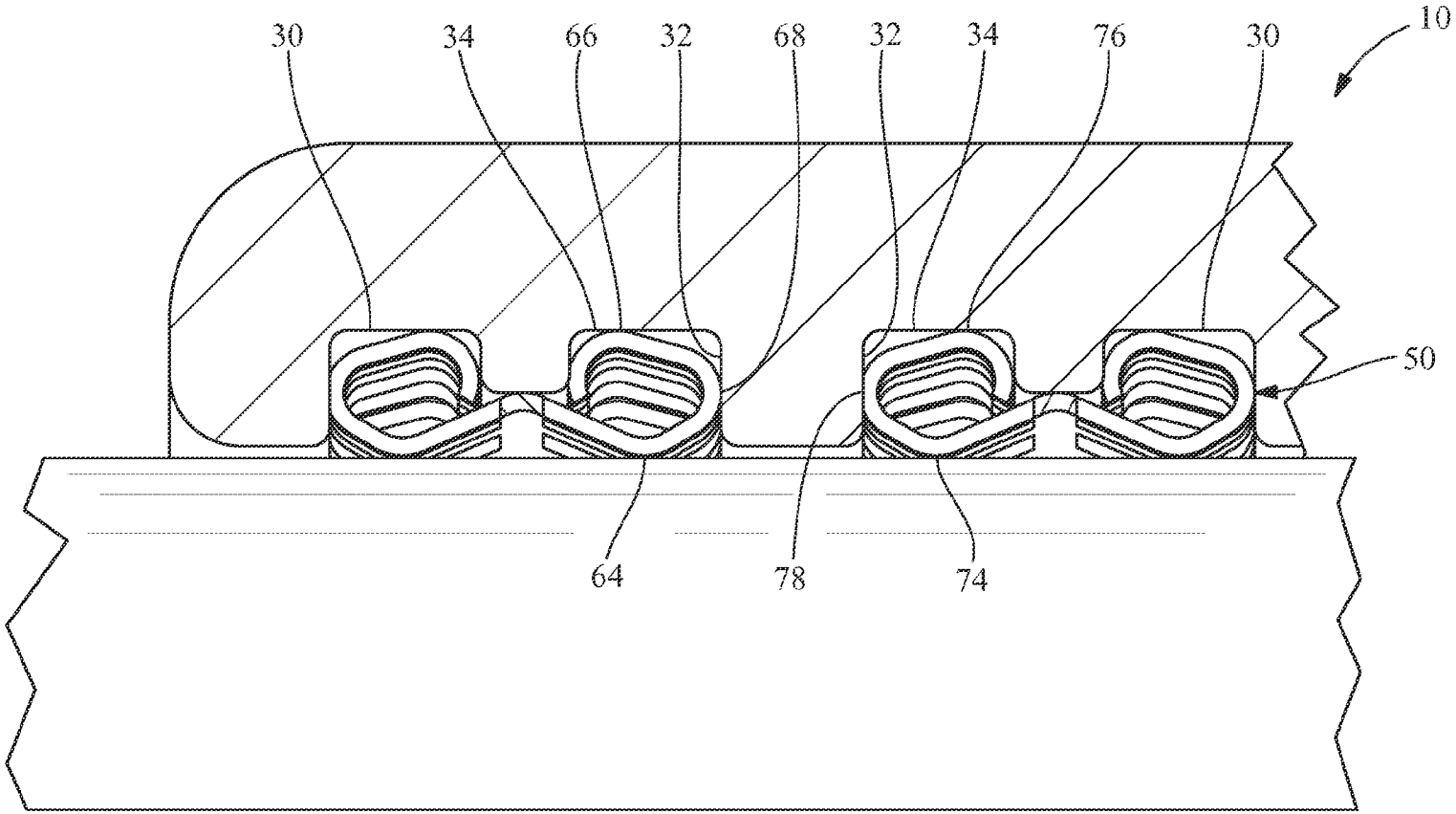
FIG. 6 is an enlarged cross-sectional view of FIG. 4 illustrating the contact elements positioned in the receiving cavity of the female contact after the male contact is inserted into the receiving cavity.

FIGS. 1, 3 and 5 illustrate a perspective view of an illustrative electrical contact assembly or receptacle 10 into which one or more contact elements 50 may be inserted. The contact 10 is shown prior to mating with a mating contact 11, such as, but not limited to, a post or mating pin 11. FIGS. 2, 4 and 6 illustrate the contact 10 and the mating contact 11 in a fully mated position. The electrical contact 10 and the mating contact 11 are shown as illustrative representations, as the particular configuration of the contact 10 and mating contact 11 may vary without departing from the scope of the invention. Therefore, the use and applicability of the contact elements 50 is not limited to the illustrative contacts 10 shown.

The mating contact 11 has a predetermined diameter and a predetermined length. The diameter of the mating contact 11 is proportioned so that the rated current and voltage can be safely transmitted. The length is selected so that the mating contact 11 will be fully received within the contact 10 without exposing electrically conducting portions of the mating contact 11 to casual contact during use and/or maintenance. The end portion of the mating contact 11 typically is rounded. The rounded end facilitates mating of the mating contact 11 to the contact 10. However, other configurations of the post may be provided without departing from the scope of the invention.

As best shown in FIGS. 1 through 4, the illustrative electrical contact 10 has a post receiving passage 14 for receiving a respective mating contact 11 therein. In the embodiment shown, the electrical contact 10 is a high amperage power contact that is capable of carrying, for example, up to about 600 amps or more, with a relatively small footprint. The electrical contact 10 has a first end 16 and an oppositely facing second end 18 which has the post receiving passage 14 therein. A conductor or wire receiving opening (not shown) extends from the first end 16 to proximate the post receiving passage 14. A conductor or wire (not shown), is inserted into a conductive wire receiving opening and is terminated thereto by crimping or other known termination methods. An insulation receiving recess may extend circumferentially around a portion of the contact 10 to allow an insulator, such as, but not limited to, a boot, to be installed. Alternatively, the electrical contact 10 may be provided in an electrical connector which includes a housing surrounding the contact 10 to provide the required electrical insulation.

The contact 10 is made from an electrically conductive material, such as, but not limited to, phosphor-bronze, brass, beryllium-copper alloy, stainless steel, etc. The contact 10 may be provided in an electrical connector with a housing body, which is made from plastic or other material having nonconductive properties, thereby allowing the housing body and the contact 10 to be engaged by the operator/user.

Contact member receiving recesses 30 extend circumferentially about the post receiving passage 14. Each contact member receiving recess 30 has a larger diameter $d_1$ (FIG. 3) than the diameter $d_2$ (FIG. 3) of the post receiving passage 14. Retaining shoulders 32 extend circumferentially about the contact member receiving recesses 30. The retaining shoulders 32 define the transition of the recesses 30 from the post receiving passage 14. An outer surface 34 extends circumferentially about the receiving recess 30 between the retaining shoulders 32. In the illustrative embodiment shown, three contact receiving recesses 30 are shown, however, any number of receiving recesses 30 can be provided based on the current to be carried, as will be more fully described.

Contact members or elements 50 are positioned in the contact member receiving recesses 30. As best shown in FIGS. 3 through 6, retaining shoulders 32 cooperate with the contact elements 50 to retain the contact elements 50 in the respective contact member receiving recesses 30. The elements 50 may be manufactured in a continuous strip, cut to length, and bent into the desired shape. Alternatively, the elements may be manufactured as individual pieces in the desired shape, such as, but not limited to, circular. The contact elements 50 may be manufactured by different methods, including, but not limited to, stamping and forming or extrusion.

In the illustrative embodiment shown, the contact elements 50 are configured to be positioned in recesses 30 of the contact 10. However, contact elements 50 may be used in any application which required a compact, reliable contact element which is required to have high current capabilities and which can be used over many cycles. Therefore, depending upon the application, the contact elements may joined by a carrier strip on the like in many different configurations, including, but not limited to, in a linear strip, in a circular configuration or in an oval configuration.

In the illustrative embodiment shown, in which the contact elements 50 are positioned in a generally cylindrical recesses 30, the outside diameter $d_3$ (FIG. 3) of each of the contact elements 50 is larger than the diameter $d_2$ of the passage 14, whereby as the contact elements 50 are inserted into the recesses 30, the contact elements 50 will be retained in the receiving recesses 30 without the need for additional mounting hardware. The inside diameter $d_4$ (FIG. 3) of the contact elements 50 is dimensioned such that the lateral clearance of the inside diameter $d_4$ is less than the diameter $d_5$ (FIG. 3) of the posts 11. The outside diameter $d_3$ of the contact elements 50 may be slightly smaller, essentially equal, or slightly larger than the diameter $d_1$ of the recesses 30.

Figure 7:
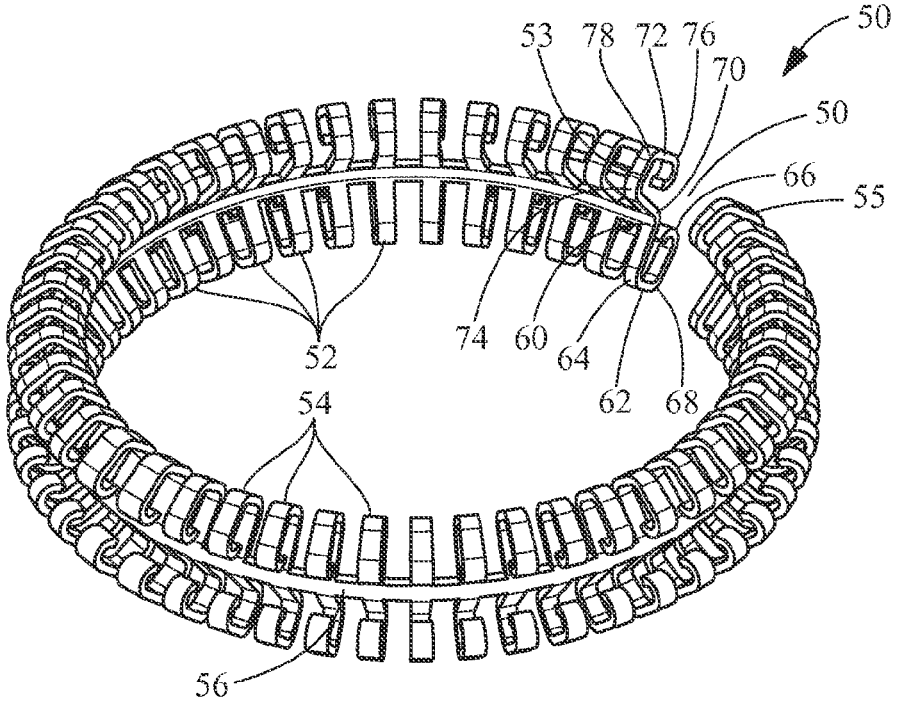
FIG. 7 is a perspective view of the illustrative contact element shown in FIG. 1.
Figure 8:
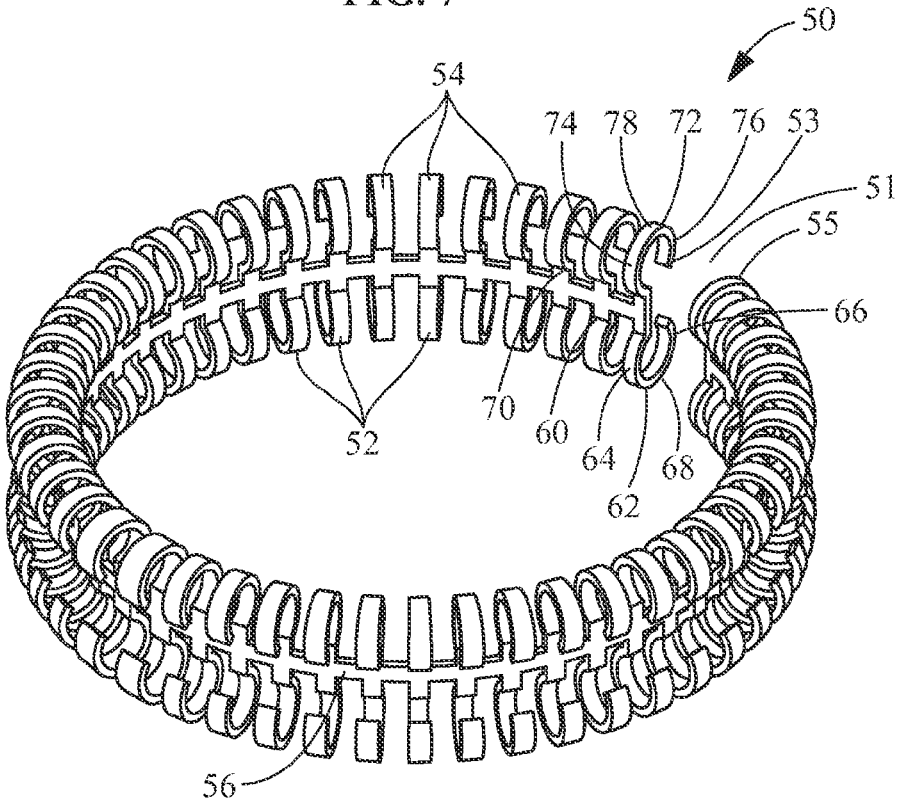
FIG. 8 is a perspective view of a second illustrative embodiment of a contact element according to the present invention.

As best shown in FIGS. 7 and 8, each contact element 50 is formed with a gap 51 provided between a first end 53 and a second end 55 of the contact element 50. This gap 51 allows the contact element 50 to be resiliently compressed to allow the contact element 50 to be inserted into the passage 14. As the contact element 50 is moved into position proximate the respective recess 30, the contact element returns toward an unstressed position, thereby causing the contact element to expand in the recess 30 and be retained therein.

As best shown in FIGS. 7 and 8, each contact member or element 50 has a multiplicity of resilient contact arms 52, 54 which extend from a carrier strip 56. Contact arms 52 have fixed ends 60, which extend from the carrier strip 56, and free ends 62, which extend from the fixed ends 60 in a direction away from the carrier strip 56. In the embodiment shown in FIG. 7, the free ends 62 have a generally diamond or square shape. Alternatively, in the embodiment shown in FIG. 8, the free ends 62 have a generally C-shaped configuration. Each free end 62 of each contact arm 52 has a first contact section 64 and a second contact section 66. Other contact sections, such as a third contact section 68, may be provided as desired. As best shown in FIGS. 3 through 6, the second contact sections 66 are positioned in the contact member receiving recesses 30 and the first contact sections 64 extend in a direction opposed to the second contact sections 66 and protrude into the post receiving passage 14.

Contact arms 54 have fixed ends 70, which extend from the carrier strip 56 in a direction opposed to the fixed ends 70, and free ends 72, which extend from the fixed ends 70 in a direction away from the carrier strip 56. In the embodiment shown in FIG. 7, the free ends 72 have a generally C-shaped configuration. Alternatively, in the embodiment shown in FIG. 8, the free ends 72 have a generally diamond or square shape. Each free end 72 of each contact arm 54 has a first contact section 74 and a second contact section 76. Other contact sections, such as a third contact section 78, may be provided as desired. As best shown in FIGS. 3 through 6, the second contact sections 76 are positioned in the contact member receiving recesses 30 and the first contact sections 74 extend in a direction opposed to the second contact sections 76 and protrude into the post receiving passage 14.

The contact elements 50 are manufactured from an electrically conductive material, such as, but not limited to, phosphor-bronze, brass, beryllium-copper alloy, stainless steel, etc. In order to enhance the electrical conductivity of the contact elements 50, the elements 50 may be plated using known techniques and materials, such techniques may include, but are not limited to immersing the contact elements 50 in a plating bath or selectively plating only the contact sections of the contact elements 50

In the embodiment shown, respective contact elements 50 are positioned in each of the receiving recesses 30. However, regardless of the shape of the recesses, the configuration of the electric contact or the configuration of the mating contact, the use of multiple contact elements 50 provides greater contact sections 64, 66, 68, 74, 76, 78 which increase the contact area between the contact elements 50 and the posts 11 and the contact elements and the outer surfaces 34 of the recesses 30. The increased contact area provides high current capabilities allowing improved electrical conductivity. Improved electrical conductivity is exemplified by lower operating temperatures of the contact elements, and lower resistive loss between connections resulting in lower voltage drop and lower power consumption. The number of contact elements 50 is proportioned so that the rated current and voltage can be safely transmitted across the contact elements 50.

With contact elements 50 properly positioned in receiving recesses 30, the mating contact 11 is inserted into a respective passage 14, as shown in FIGS. 2, 4 and 6. As insertion occurs, the contact arms 52, 54 are resiliently deformed toward respective outer contact surfaces 34 of the contact member receiving recesses 30. As this occurs, the second contact sections 66, 76 are deflected toward the outer surfaces 34 of the receiving recesses 30 causing the second contact sections 66, 76 to exert a force on the outer surfaces 34. This causes the second contact sections 66, 76 to be placed in physical and electrical engagement with the outer surfaces 34. In addition, the first contact sections 64, 74 exert force on the mating contact 11 as insertion continues, thereby placing first contact sections 64, 74 in physical and electrical engagements with the posts 11. As the first contact sections 64, 74 engage the posts 11 as insertion occurs, the contact sections 64, 74 wipe across the mating contact 11 to provide a more reliable electrical connection there between. The combination of numerous contact sections and the resilient forces exerted thereon, result in a stable electrical connection which can safely and effectively transmit high current there across.

In various embodiments, third contact sections 68, 78 provide additional points of contact. As a mating contact 11 is inserted into a respective passage 14, the mating contact 11 engages the contact elements 50 and causes the contact elements 50 to move in a direction in line with the direction of insertion of the mating contact 11. This movement occurs until the third contact sections 68, 78 are positioned in engagement with respective shoulders 32 of the recesses 30. The continued insertion of mating contact 11 in the passage 14 maintains the third contact sections 68, 78 in contact with respective shoulders 32, thereby placing third contact sections 68, 78 in physical and electrical engagement with the respective shoulders 32.

The use of multiple contact sections 64, 66, 68, 74, 76, 78 on multiple contact arms 52, 54 allows the contact elements 50 to carry high amperage required by the electrical power contacts without increasing the length or diameter of the passage 14. Significantly more contact surfaces are placed in a given length (i.e., higher density of contact surfaces) thereby allowing an increased performance in power transfer across the contact elements 50. The redundant contact sections provide for passage of high amperage current with millivolt drop (for example, but not limited to, 5-25 MVD) and lower temperature rise at high current (for example, but not limited to, 10-75 degrees Celsius with current limits to 1000 amp), thereby increasing the performance of the contact elements 50 by greater than 50%, greater than 60%, greater than 70%, between about 50% and about 70%, between about 50% and about 60%, or any suitable combination, sub-combination, range, or sub-range therein, over known contacts.

In the illustrative embodiment, the contact elements 50 shown are made from material having a thickness of about 0.004 inches to about 0.012 inches and an appropriate cross-sectional area to accommodate from about 25 amps to about 1200 amps, without failure or excessive heat buildup in the holder. However, other thicknesses and ratings of power transfer may be used without departing from the scope of the invention. The use of multiple contact elements in the same contact allows for greater power transfer without failure or excessive heat buildup in the holder.

The configuration of the contact 10 and the contact elements 50 allow for the contact to be mated with the mating contact 11 from any direction. In various circumstances, it is difficult to manipulate and twist the wire connected to the contact element 50. Often because of lack of space or the inflexibility of the wire, it is important that the contact 10 be able to be terminated to the post regardless of the orientation of the wire relative to the post. As the contact element 50 is operable no matter the orientation relative to the post, the present invention allows the termination of the wire to the post without damage to the wire or the post.

While the contact element can be used in many different housings for many different applications, the configuration allows for use with high amperage electrical connections which may require up to 1200 amps or more per contact. The contact elements, are also scalable, allowing the contacts to be sized for the desired application, such as, for example, the contact elements can be configured to operate with 4 AWG wire as well as 70 AMP contacts.

While the invention has been described with reference to a illustrative embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A contact element for providing high current capabilities between an electrical contact and a mating contact, the contact element comprising:

multiple first resilient contact arms extending from a carrier strip, the first resilient contact arms having first contact sections and second contact sections, the first contact sections of the first resilient contact arms electrically engage the mating contact when the mating contact is fully inserted into the electrical contact, the second contact sections of the first resilient contact arms electrically engage a portion of the electrical contact when the mating contact is fully inserted into the electrical contact;

multiple second resilient contact arms extending from the carrier strip, the second contact arms having first contact sections and second resilient contact sections, the first contact sections of the second resilient contact arms electrically engage the mating contact when the mating contact is fully inserted into the electrical contact, the second contact sections of the second resilient contact arms electrically engage a portion of the electrical contact when the mating contact is fully inserted into the electrical contact;

wherein the first contact sections of the first resilient contact arms, the second contact sections of the first resilient contact arms, the first contact sections of the second resilient contact arms, and the second contact sections of the second resilient contact arms provide redundant contact sections which allow for the passage of a high amperage current with low resistance and low temperature;

wherein the first resilient contact arms extend from the carrier strip in an opposite direction of the second resilient contact arms;

wherein the first resilient contact arms have fixed ends and free ends, the first and second contact sections of the first resilient contact arms positioned on the free ends of the first resilient contact arms, the second resilient contact arms have fixed ends and free ends, the first and second contact sections of the second resilient contact arms positioned on the free ends of the second resilient contact arms.

2. The contact element as recited in claim 1, wherein the first contact sections of the first resilient contact arms extend in a direction which is opposed to the second contact sections of the first resilient contact arms, and the first contact sections of the second resilient contact arms extend in a direction which is opposed to the second contact sections of the second resilient contact arms.

3. The contact element as recited in claim 1, wherein the free ends of the first resilient contact arms and the free ends of the second resilient contact arms have a generally c-shaped configuration.

4. The contact element as recited in claim 1, wherein the free ends of the first resilient contact arms and the free ends of the second resilient contact arms have a generally diamond shaped configuration.

5. The contact element as recited in claim 1, wherein third contact sections are provided on the first and second resilient contact arms.

6. The contact element as recited in claim 1, wherein the contact element has a generally cylindrical shape, with a gap provided therein, the gap allowing the contact element to be resiliently deformed.

7. An electrical contact for mating with a mating contact, the electrical contact comprising:

a passage for receiving a mating contact, the passage having at least one recess, the at least one recess having an outer contact surface;

at least one contact element positioned in the at least one recess, the at least one contact element comprising:

multiple first resilient contact arms extending from a carrier strip, the first resilient contact arms having first contact sections and second contact sections, the first contact sections of the first resilient contact arms electrically engage the mating contact when the mating contact is fully inserted into the electrical contact, the second contact sections of the first resilient contact arms electrically engage the outer contact surface of the at least one recess when the mating contact is fully inserted into the electrical contact;

multiple second resilient contact arms extending from the carrier strip, the second resilient contact arms having first contact sections and second contact sections, the first contact sections of the second resilient contact arms electrically engage the mating contact when the mating contact is fully inserted into the electrical contact, the second contact sections of the second resilient contact arms electrically engage the outer contact surface of the at least one recess when the mating contact is fully inserted into the electrical contact;

wherein the first contact sections of the first resilient contact arms, the second contact sections of the first resilient contact arms, the first contact sections of the second resilient contact arms, and the second contact sections of the second resilient contact arms provide redundant contact sections which allow for the passage of a high amperage current between the mating contact and the outer contact surface with low resistance and low temperature;

wherein the at least one recess has retaining shoulders to retain the at least one contact element in the at least one recess;

wherein first resilient contact arms extend from the carrier strip in an opposite direction of second resilient contact arms;

wherein the first resilient contact arms have fixed ends and free ends, the first and second contact sections of the first resilient contact arms positioned on the free ends of the first resilient contact arms, the second resilient contact arms have fixed ends and free ends, the first and second contact sections of the second resilient contact arms positioned on the free ends of the second resilient contact arms.

8. The electrical contact as recited in claim 7, wherein third contact sections are provided on the first and second resilient contact arms, the third contact sections of the first and second contact arms electrically engage the retaining shoulders of the at least one recess when the mating contact is fully inserted into the electrical contact.

9. The electrical contact as recited in claim 7, wherein the at least one contact element has a generally cylindrical shape, with a gap provided therein, the gap allowing the contact element to be resiliently deformed.

10. The electrical contact as recited in claim 7, wherein more than one at least one recess are provided and more than one at least one contact element are provided in the electrical contact.

11. The electrical contact as recited in claim 7, wherein the first contact sections of the first resilient contact arms extend in a direction which is opposed to the second contact sections of the first resilient contact arms, and the first contact sections of the second resilient contact arms extend in a direction which is opposed to the second contact sections of the second resilient contact arms.

12. The electrical contact as recited in claim 11, wherein the free ends of the first resilient contact arms and the free ends of the second resilient contact arms have a generally c-shaped configuration.

13. The electrical contact as recited in claim 11, wherein the free ends of the first resilient contact arms and the free ends of the second resilient contact arms have a generally diamond shaped configuration.

14. An electrical contact comprising:

a passage for receiving a mating contact, the passage having at least one recess, the at least one recess having retaining shoulders and an outer contact surface;

at least one contact element positioned in the at least one recess, the at least one contact element comprising:

multiple first resilient contact arms extending from a carrier strip, the first resilient contact arms having first contact sections and second contact sections, the first contact sections of the first resilient contact arms electrically engage the mating contact when the mating contact is fully inserted into the electrical contact, the second contact sections of the first resilient contact arms electrically engage the outer contact surface of the at least one recess when the mating contact is fully inserted into the electrical contact;

multiple second resilient contact arms extending from the carrier strip, the second resilient contact arms having first contact sections and second contact sections, the first contact sections of the second resilient contact arms electrically engage the mating contact when the mating contact is fully inserted into the electrical contact, the second contact sections of the second resilient contact arms electrically engage the outer contact surface of the at least one recess when the mating contact is fully inserted into the electrical contact; and third contact sections provided on the first and second resilient contact arms, the third contact sections of the first and second resilient contact arms electrically engage the retaining shoulders of the at least one recess when the mating contact is fully inserted into the electrical contact.

15. The electrical contact as recited in claim 14, wherein the at least one contact element has a generally cylindrical shape, with a gap provided therein, the gap allowing the contact element to be resiliently deformed.

* * * * *